US005233388A

United States Patent [19]

Reese et al.

[11] Patent Number: 5,233,388

[45] Date of Patent: Aug. 3, 1993

[54] APPARATUS FOR CONTROLLING BELT GUIDANCE IN AN ELECTROPHOTOGRAPHIC PRINTING MACHINE

[75] Inventors: Scott A. Reese, Farmington; Richard M. Dastin, Fairport; Stephen J. Wenthe, Jr., West Henrietta; Vittorio R. Castelli, Yorktown Heights, all of N.Y.

[73] Assignee: Xerox Corporation, Stamford, Conn.

[21] Appl. No.: 756,000

[22] Filed: Sep. 6, 1991

[51] Int. Cl.[5] ..... G03G 15/00

[52] U.S. Cl. ..... 355/212; 355/72

[58] Field of Search ..... 355/210, 211, 271, 212, 355/208, 72, 74; 198/835, 840

[56] References Cited

U.S. PATENT DOCUMENTS

| | | | |
|---|---|---|---|
| 4,483,607 | 11/1984 | Nagayama | 355/3 TR |
| 4,551,001 | 11/1985 | Yokota | 355/3 BE |
| 4,556,308 | 12/1985 | Hoppner et al. | 355/3 R |
| 4,568,617 | 2/1986 | Wilkes | 428/595 |
| 4,609,277 | 9/1986 | Yokoyama et al. | 355/3 R |
| 4,657,370 | 4/1987 | Forbes, II et al. | 355/3 BE |
| 4,878,769 | 11/1989 | Schepp | 384/618 |
| 4,943,831 | 7/1990 | Geraets et al. | 355/290 |
| 4,984,027 | 1/1991 | Derimiggio et al. | 355/290 |
| 5,017,696 | 5/1991 | Mitomi et al. | 355/271 |
| 5,061,961 | 10/1991 | Jacobs et al. | 355/212 |
| 5,070,365 | 12/1991 | Agarwal | 355/212 |
| 5,076,568 | 12/1991 | de Jong et al. | 271/275 |
| 5,077,575 | 12/1991 | Narumiya et al. | 355/72 |

*Primary Examiner*—A. T. Grimley
*Assistant Examiner*—Thu Dang
*Attorney, Agent, or Firm*—Kenyon & Kenyon

[57] ABSTRACT

Low lateral force rolls used in supporting a photoreceptor belt to minimize lateral belt motion on a multi-pass color copier. Single piece, widely spaced mounting through shafts are used in connection with side support structure of the module drawer to reduce inboard and outboard misalignment. An integral tensions slide/side plate guidance control system is employed to reduce misalignment of the tension roller. Use of these features aid in minimizing undesirable belt movement.

13 Claims, 7 Drawing Sheets

APPARATUS FOR CONTROLLING BELT GUIDANCE IN AN ELECTROPHOTOGRAPHIC PRINTING MACHINE

BACKGROUND AND DISCUSSION OF THE INVENTION

This invention relates generally to an electrophotographic printing machine, and more particularly concerns a sheet transport for moving a sheet in a path to enable a toner image to be transferred thereto. The invention also particularly concerns a sheet transport for moving a sheet in a recirculating path to enable successive toner powder images to be transferred thereto in superimposed registration with one another while minimizing unwanted belt movement that might otherwise adversely affect image quality.

The marking engine of an electronic reprographic printing system is frequently an electrophotographic printing machine. In such a machine, a photoconductive belt is charged to a substantially uniform potential to sensitize the belt surface. The charged portion of the belt is thereafter selectively exposed. Exposure of the charged photoconductive belt or member dissipates the charge thereon in the irradiated areas. This records an electrostatic latent image on the photoconductive member corresponding to the informational areas contained within the original document being reproduced. After the electrostatic latent image is recorded on the photoconductive member, the latent image on the photoconductive member which is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto. This process is repeated a plurality of cycles for differently colored images and their respective complementarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid or a powder material.

In the process of black and white printing, the copy sheet is advanced from an input tray to a path internal the electrophotographic printing machine where a toner image is transferred thereto and then to an output catch tray for subsequent removal therefrom by the machine operator. In the process of multi-color printing, the copy sheet moves from an input tray through a recirculating path internal the printing machine where a plurality of toner images is transferred thereto and then to an output catch tray for subsequent removal. With regard to multi-color printing, a sheet gripper secured to a transport receives the copy sheet and transports it in a recirculating path enabling the plurality of different color images to be transferred thereto. The sheet gripper grips one edge of the copy sheet and moves the sheet in a recirculating path so that accurate multi-pass color registration is achieved. In this way, magenta, cyan, yellow, and black toner images are transferred to the copy sheet in registration with one another.

Some systems which have been designed for transporting a copy sheet into registration with a toner image developed on a moving member accelerate the copy sheet during transfer of the toner image from the moving member to the copy sheet. Such acceleration may occur when the leading portion of the sheet is being negotiated through a nonlinear path while at the same time the trailing portion of the copy sheet is traveling through the transfer zone. The above acceleration may cause a deterioration of the integrity of the image produced on the copy sheet due to slip between the copy sheet and the moving member while the sheet is traveling through the transfer zone. An example of the above deterioration is a blurred or smeared image produced on the copy sheet.

A problem that confronts machines designed for color copying, which does not necessarily occur in black and white copying, is unwanted belt motion in both process and lateral directions during the movement of the photoreceptor belt. Unlike black and white copying, in a xerographic color copier, using a multiple pass color registration scheme, the accuracy of the color on color alignment or registration is extremely important to image quality. Where excessive lateral belt motion occurs, the images are not properly registered to create an acceptable image.

For acceptable images, lateral belt motion should be limited to about 80 microns or less. It has been found that lateral motion from pass to pass on photoreceptor belt systems could exceed 300 microns or more. After incorporating the invention described herein, this lateral belt motion can be less than 80 microns, and certainly less than the 100 microns which is desirable.

The invention described herein utilizes three Low Lateral Force (LLF) rolls supporting the photoreceptor belt to minimize lateral belt motion on a multi-pass color copier. A combination of the rolls, the module mounting, belt guidance and tolerance system all contribute to achieving this desirable reduction in lateral belt motion. Although any one of these features can be included independently of the other, it is found that all contribute to minimizing undesirable belt motion.

In the past the primary function of LLF rolls has been to allow the reaction force transmitted into the belt edge to be dissipated in deflecting LLF pedals. This provides edge guidance of a flexible belt without edge damage, and has been used in many production AMAT belt products. However, the multi-pass color on color registration system requires that the belt move in as slow, lateral rate as possible to minimize color to color placement errors. Since lateral motion in a dynamic system cannot be completely eliminated, it is necessary to minimize the rate at which it changes in time. The system described above, referred to as a "stiff" LLF system, achieves this result. It has been found that the lower the axial roll stiffness, the higher the axial belt motion. Where stiffer rolls are used, the less capable the rolls are of dissipating the edge force from the edge guide.

The system developed herein is one that minimizes lateral belt motion, as it is edge guided, through the use of axial roll stiffness to reduce the lateral belt tracking rate and thus the amount of rebound reaction to the edge guide force. For this purpose the drive and strip rolls have the highest axial roll stiffness to provide primary resistance to lateral motion. The tension roll requires lower axial roll stiffness in order to do the majority of the dissipation of the belt edge force as the belt is guided at this roll.

The alignment control to enable running such a stiff low lateral force is accomplished by basically three approaches. A single piece, widely spaced, mounting through shaft is utilized to reduce the tolerance impacts of the xerographic module drawer inaccuracies and reduce the inboard to outboard misalignment. An integral tension slide/side plate guidance control system is employed to reduce the misalignment of the tension roll, which is the largest contributor to internal belt module misalignment. Finally, controlling the tolerances of the mounting system for the xerographic module drawer, the tolerance control plan assures that the other elements of the system are mounted properly in the machine frame to achieve the desired tolerances and resulting low lateral belt motion.

The above has been a brief description of deficiencies in the prior art and advantages of the invention. Other advantages will become apparent from the detailed description of the preferred embodiment which follows.

Other features of the present invention will become apparent as the following description proceeds and upon reference to the drawings.

DETAILED DISCUSSION OF THE PREFERRED EMBODIMENT

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
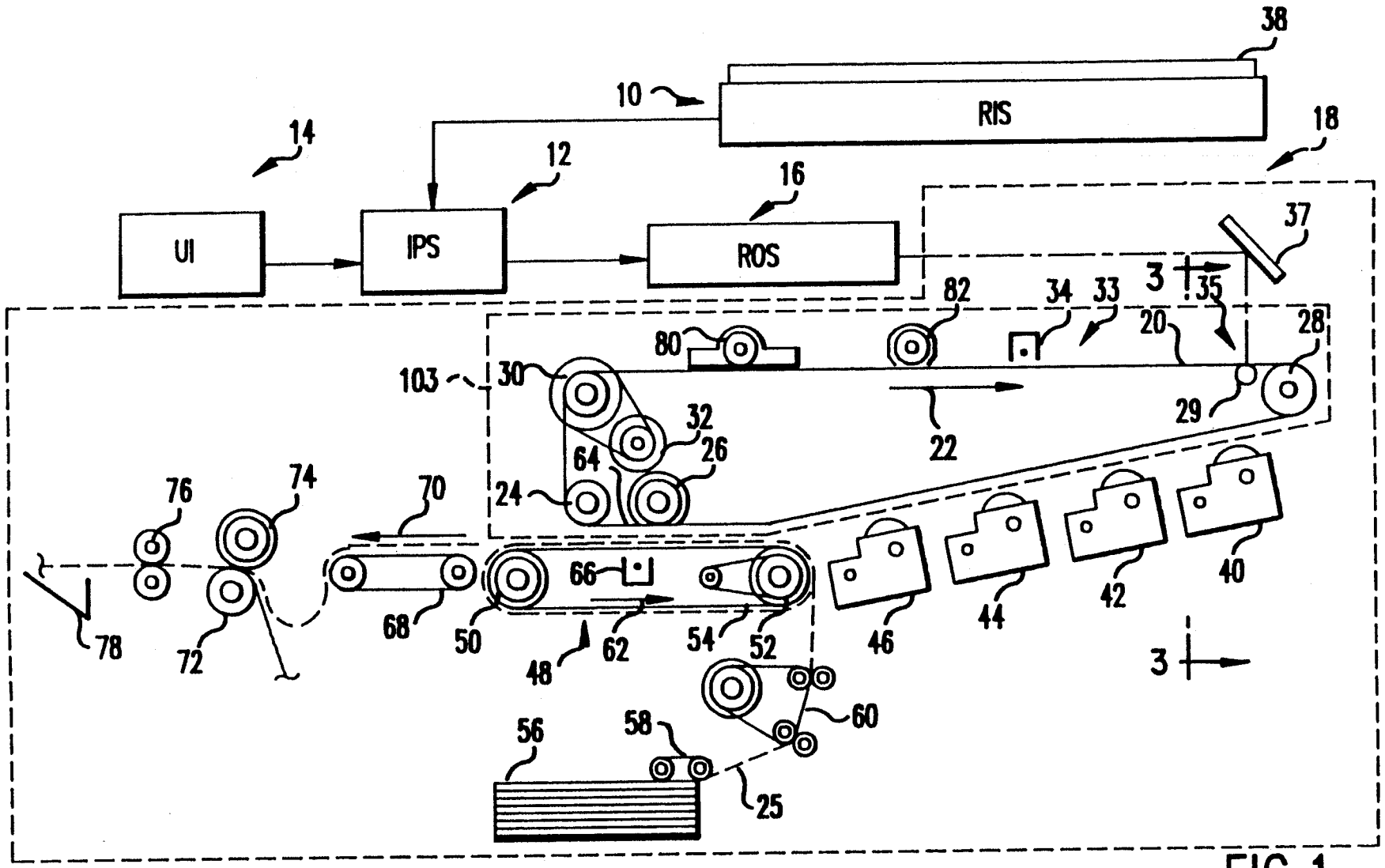
FIG. 1 is a schematic elevational view illustrating an electrophotographic printing machine incorporating the features of the present invention therein.

For a general understanding of the features of the present invention, reference is made to the drawings. In the drawings, like references have been used throughout to designate identical elements. FIG. 1 is a schematic elevational view of an illustrative electrophotographic machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser having a rotating polygon mirror block associated therewith. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatical potential.

Next, the charged photoconductive surface is rotated to an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is adapted to be developed with cyan developer material. Another latent image is adapted to be developed with magenta developer material and the third latent image is adapted to be developed with yellow developer material. The latent images formed by ROS 16 on the photoconductive belt correspond to the signals transmitted from IPS 12.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface.

Developer units 40, 42 and 44, respectively, apply toner particles of a specific color which corresponds to the complement of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 1, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of sheet gripper 84. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. Further details of the sheet transport apparatus will be discussed hereinafter with reference to FIGS. 2–10. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure role 72. The sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
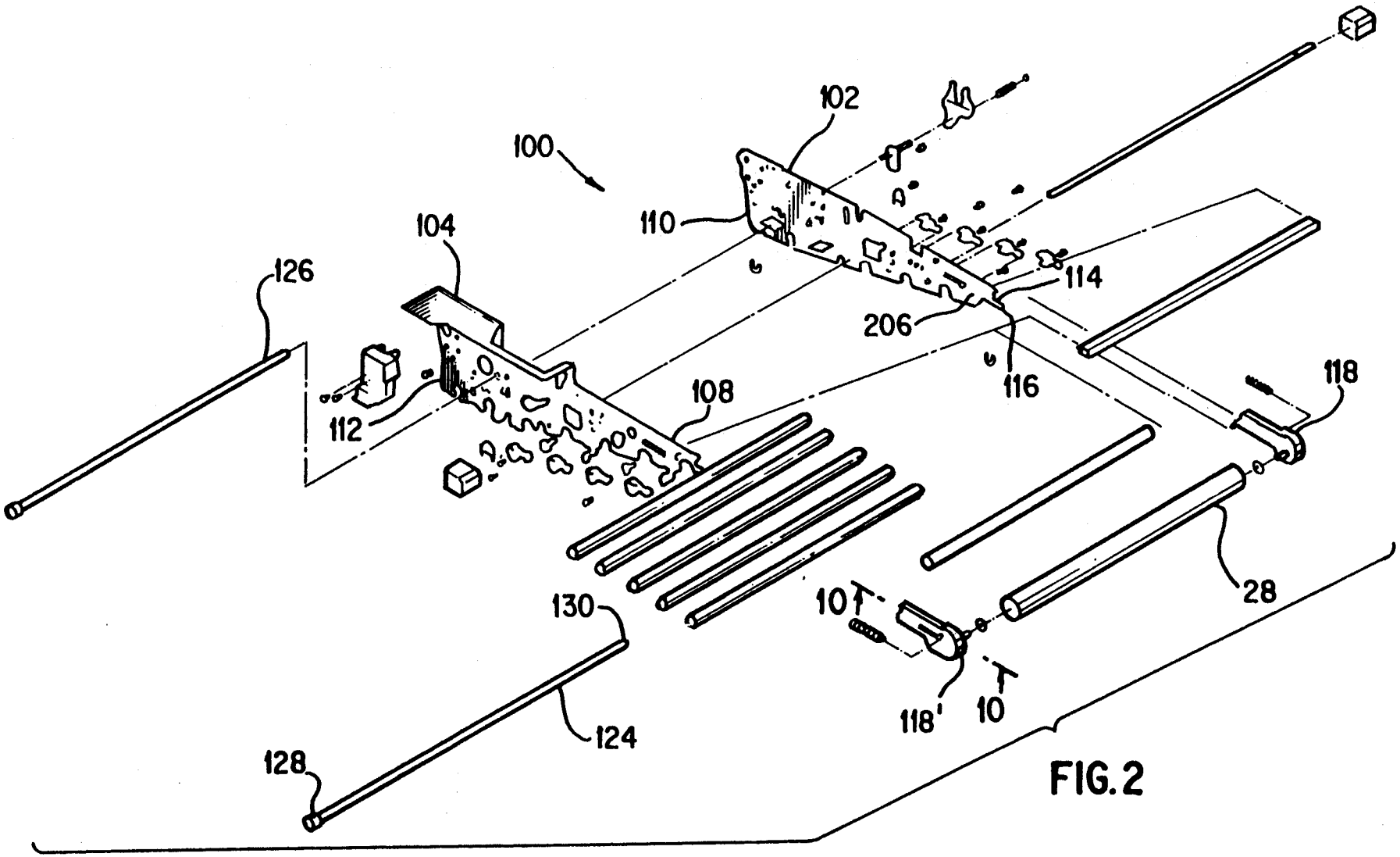
FIG. 2 is an exploded perspective view of the belt control system of the invention.

As can be seen in the exploded view of FIG. 2, a belt module assembly 100 includes two opposed plate assemblies, a rear plate assembly 102 and a front plate assembly 104, which supports other elements of assembly and about which the belt 20 is constrained for movement within the module.

Each plate assembly 102, 104 has a front end 106, 108 and a rear end 110, 112. The front end 106 of plate assembly 102 includes at its outermost extension a tongue 114 with a bulb 116 for engaging slide tension guide assembly. Slightly rearwardly of tongue 114 is a slot 120 for receiving a portion of slide tension assembly 118 which will be discussed in more detail below.

The front and rear plate assemblies 102, 104 are arranged in spaced relationship a distance at least as large as the length of the tension roller 28. The tension roller 28 is arranged adjacent the front end 106, 108 of the side assemblies 102, 104 and engaged by slide tension assemblies 118, 118' to maintain tension on belt 20. Displaced rearwardly from the tension roller 28 is a drive roller 30 adjacent rear end 110 of the rear plate assembly 102 (see FIG. 5). Beneath drive roller 30, and also displaced rearwardly at a position adjacent the rear end 110 of rear side assembly 102, is a strip roller 122. The photoreceptor belt 20 is entrained about these rolls 28, 30, 122 for rotation or movement along a continuous path while tension is maintained between the belt and the rolls by the tension roller 28 and its accompanying tension assemblies.

Each of these rollers are substantially stiffer than those that have been used before. It is this "stiffness" that minimizes unwanted belt movement. In the embodiments described herein, the stiffness of the rollers range anywhere from 92% to 200% increase in actual axial roller stiffness compared to rollers that have been used before. For example, the drive roller has achieved 156% reduction in belt displacement. At a lateral force of 900 grams, the belt displacement of the drive roller of the invention is about 0.125 mm when compared to about 0.32 mm of rollers used in the past at this lateral force level. The belt displacement of the strip roller has been reduced from about 0.39 mm to about 0.13 mm at a lateral force of about 900 grams. This results in a 200% decrease in belt displacement or axial roller stiffness. Finally, the tension roller achieves about a 92% increase in axial stiffness. Specifically, the displacement has been reduced from about 0.23 mm to about 0.12 mm, again at 900 grams of lateral force. These values are obtained at a wrap angle of about 90° for each of the drive roller and the strip roller, but a wrap angle of about 180° for the belt tension roller, with a belt tension of about 16 pounds. The following is a chart showing the characteristic of these rollers with the desired stiffness.

| Lateral Force | Drive Roller | Strip Roller | Tension Roller |
|---|---|---|---|
| 700 g | .095 mm | .09 mm | .065 mm |
| 500 g | .06 mm | .065 mm | .035 mm |
| 200 g | .03 mm | .04 mm | .02 mm |

This chart demonstrates the amount of belt displacement achieved by the stiffer rollers at the same wrap angle and belt tension as discussed above. This stiffness is achieved by reducing groove depth in standard rollers from about 5 to 10 mm to about 1 mm. The tension roller is still more flexible than the other and has grooves between 3–5 mm, preferably about 4.5 mm.

Extending entirely through both front and rear assemblies 102, 104 are two spaced, one piece through shafts 124, 126. The first through shaft is located in a position on the side assemblies adjacent the tension roller and the second through shaft is located adjacent the strip roll. Each tension shaft 124 has a head 128 at its outboard end and a beveled surface 130 at the endboard end. The internal portion of the machines include a flat mounting bracket 132 and a V-mounting bracket 134 for engaging the first and second one piece through shafts 124, 126, respectively, as shown schematically in FIG. 6. As can be seen more clearly in FIG. 4, cantilevered spring 136 is located on a fixed structure portion of the machine to engage the beveled surface 130 on through shaft 126 to force the through shaft against a module bracket 132 or 134.

Figure 3:
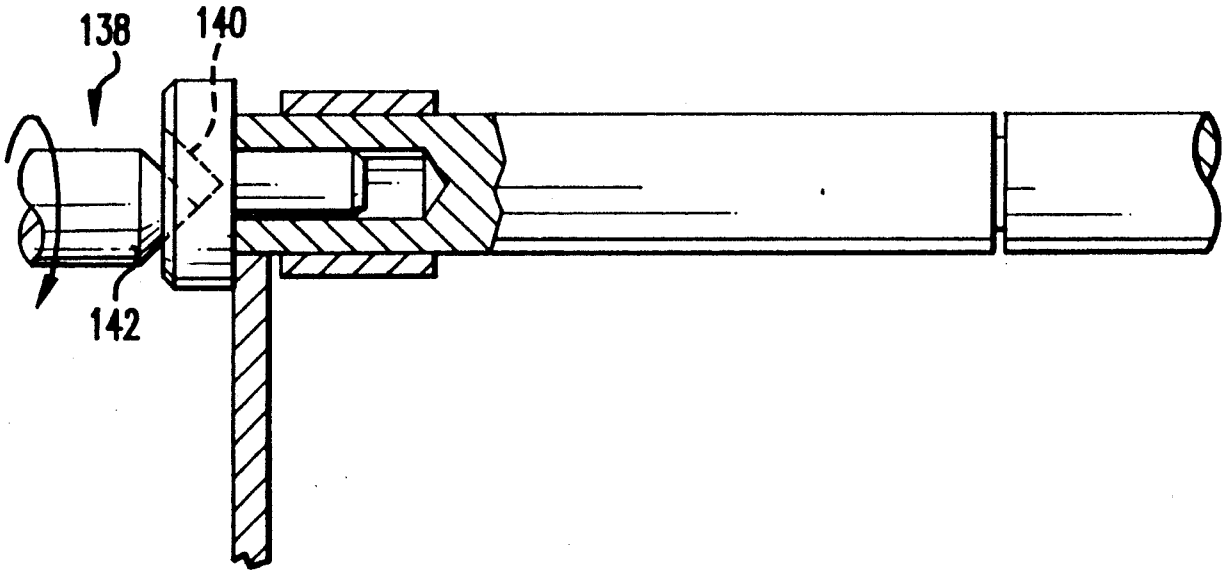
FIG. 3 is a first enlarged cross-sectional view of the one piece shaft of FIG. 2.
Figure 4:
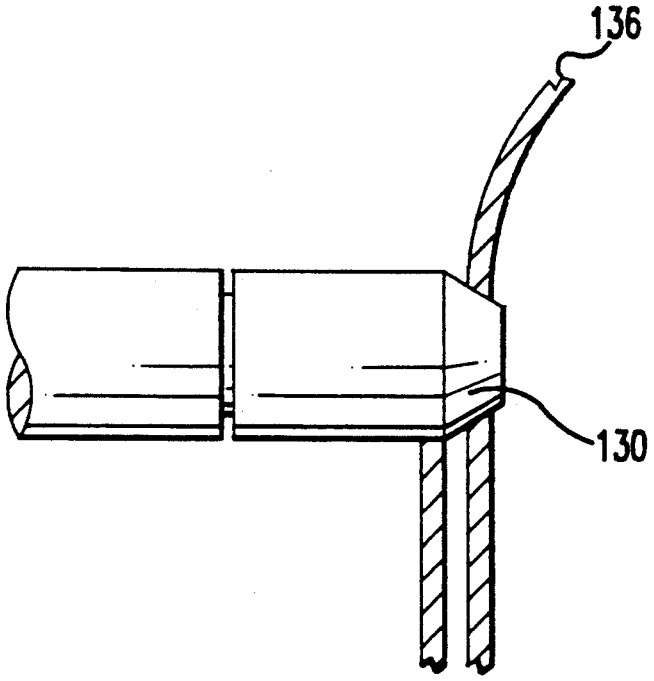
FIG. 4 is a second enlarged cross-sectional view of the one piece shaft of FIG. 2.
Figure 5:
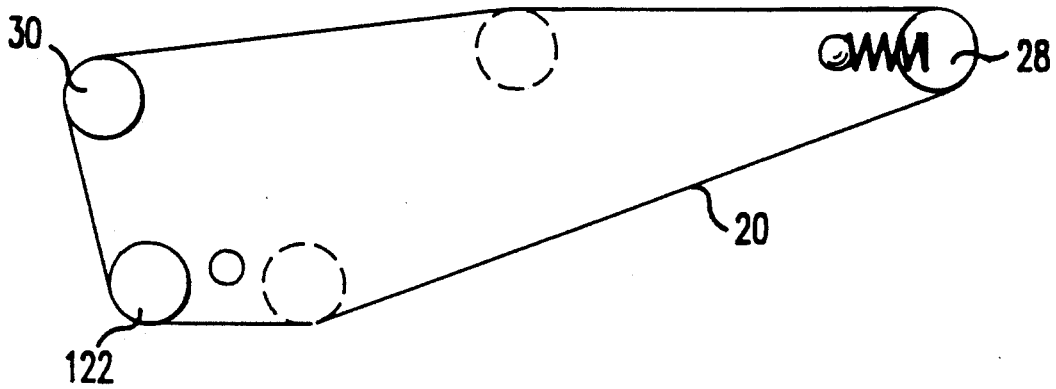
FIG. 5 is a schematic planar view showing the belt system used in the electrophotographic printing machine of FIG. 1.
Figure 6:
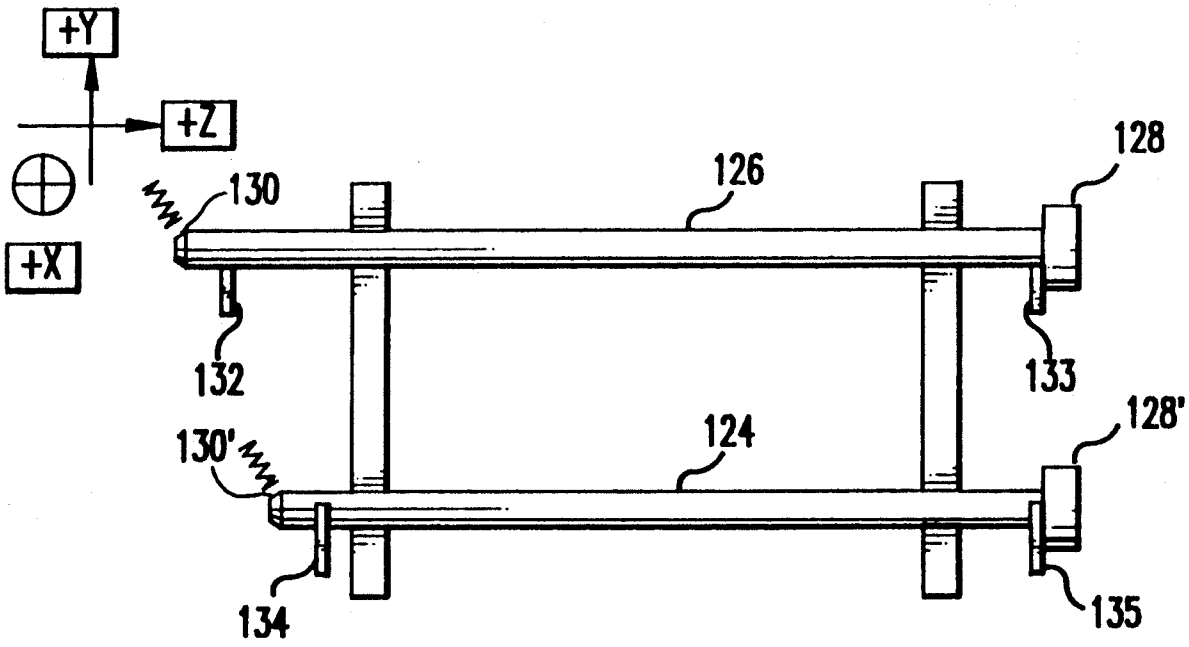
FIG. 6 is a schematic end view of the belt control system of FIG. 2.

A latch assembly 138 is located on the xerographic module drawer (XMD) to cooperate with the head 128 of throughput shaft 126 to locate the shaft at the outboard side adjacent XMD bracket as shown in FIG. 3 and schematically in FIG. 6. In this particular embodiment, the latch mechanism includes a conical recess 140 located in head 128 of the shaft 126 and a cone-shaped screw 142 for engaging the surface that defines that recess. As the screw 142 is moved into the recess 142 it forces head 128 to a position abutting XMD bracket 144 to ensure that it is locked in the correct position. This system reduces the mounting tolerance impacts of the xerographic module drawer (XMD) inaccuracy and reduces the inboard to outboard misalignment due to internal belt module tolerances.

Figure 7:
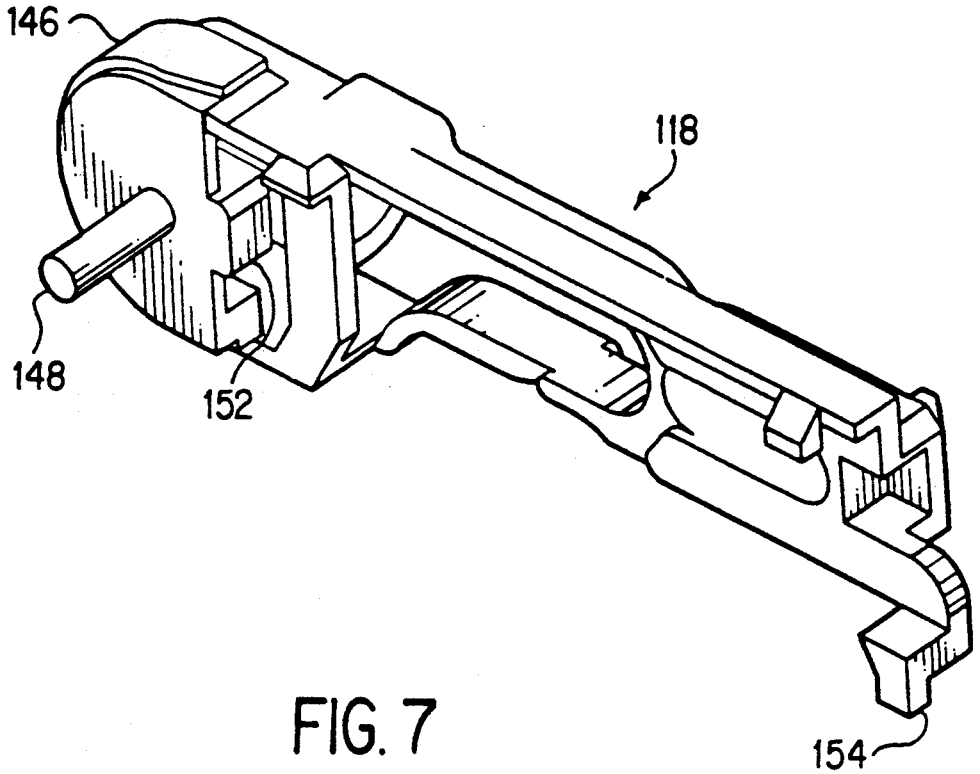
FIGS. 7 and 8 are enlarged perspectives of the slide assembly of FIG. 2.
Figure 8:
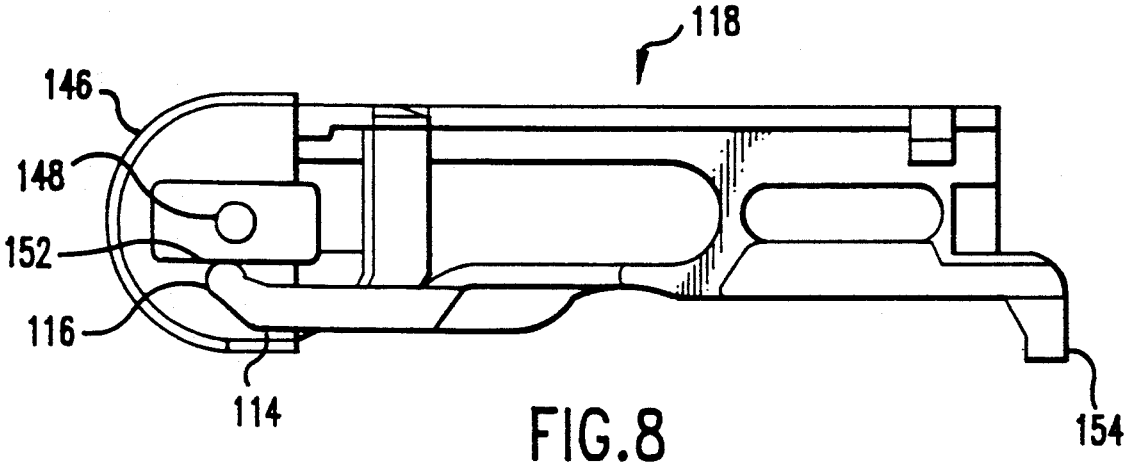
Figure 9:
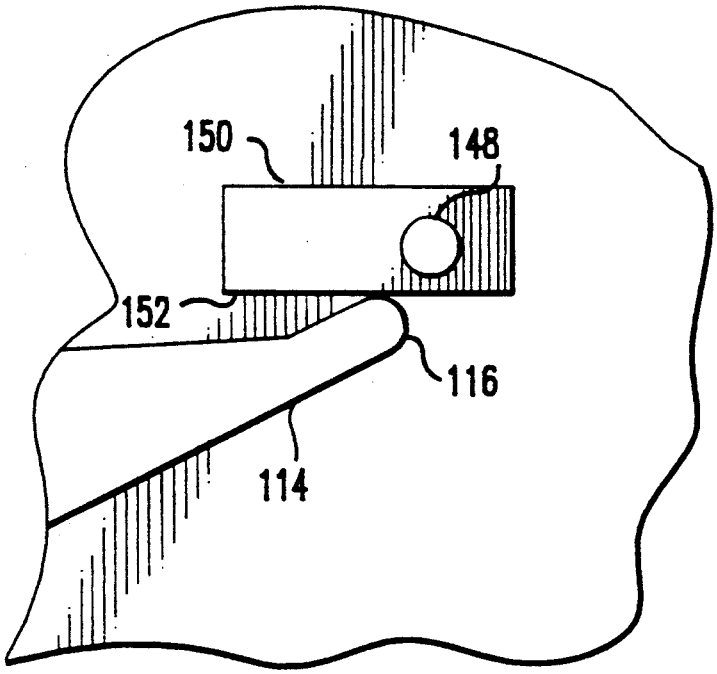
FIG. 9 is a plan view of the slide assembly of FIG. 7 showing engagement with the tongue of the plate assembly.
Figure 10:
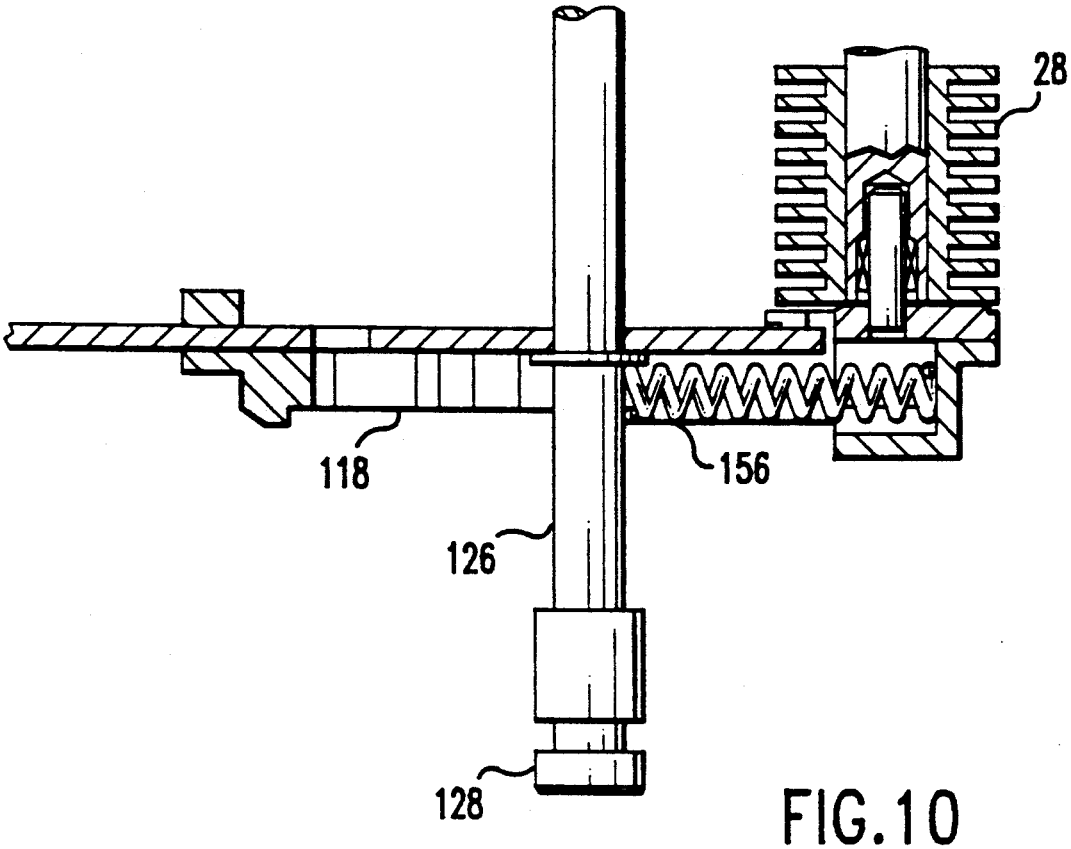
FIG. 10 is an enlarged perspective of the slide assembly taken along lines 10—10 of FIG. 2.

As can be seen in FIGS. 7 and 8, where enlarged views of the tension slide assembly 118 are shown, this assembly includes a front portion 146 having a pin 148 extending laterally therefrom for rotatably engaging the tension roller 28 from either end as shown in FIG. 2. Pin 148 is mounted on a boss 150 having a lower cam surface 152 for engagement by tongue 114 of front portion 146 of slide assembly 118 (see FIG. 9). Extending rearwardly from front portion 146 is a lip 154 at its distal end, extending downwardly and laterally therefrom for engaging the slot 120 in the plate assembly. This slide assembly 118 is configured to receive coil spring 156 as shown in FIG. 10. Spring 156 is located so that one end engages a spring engaging surface of the slide assembly 118 and its other end engaging through shaft 126 such that the slide assembly can move relative to the through shaft as defined by the length of the slot, and maintain tension on the tension roll and ultimately on the belt. Front portion 146 of the tension guide assembly defines a guide surface having a radius of curvature to accommodate and engage a portion of the belt as it moves about its continuous path. Because of the location of tongue 114 on the side assemblies engaging lower cam surface 152 of boss 150 as shown, the position of the slide assembly is always accurately maintained. This reduces misalignment of the tension roller 28 which is the largest contributor to internal belt module misalignment, and thus lateral belt motion and edge force.

Mounting control techniques have also been used to control the external mounting position of the photoreceptor module. The module is compliant to the xerographic module drawer mounting points. These points in turn are dependent on the machine frame bushing locations. This tolerance control plan is carried through the xerographic module drawer design and its mounting of the machine frame. With this plan and the other features discussed above, the lateral belt motion can be limited to less than 80 microns, and preferably less than 50 microns. This is well within the design system and should produce color prints of enhanced clarity and acceptability to the consumer.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for controlling a belt motion in an electro-photographic printing machine comprising:

a continuous photoreceptor belt for receiving an image;

a drive roller for driving said belt about a continuous path;

a motor coupled to said drive roller providing power to said drive roller for driving said belt;

a tension roller engaging said belt to maintain tension thereon;

a strip roller for engaging said belt at a position displaced from said tension roller and said drive roller, such that said drive roller and said strip roller each have a higher axial roll stiffness than said tension roller;

said belt being entrained about said drive, tension, and strip roller;

a front support structure and a rear support structure arranged in spaced relationship for supporting said drive, tension, and strip rollers; and a first single piece mounting shaft and a second single piece mounting shaft, each extending through said front and rear support structures for mounting said belt and drive, tension, and strip rollers to a portion of said printing machine.

2. The apparatus according to claim 1 wherein said first single piece mounting shaft is located in spaced relationship with respect to said second single piece mounting shaft.

3. The apparatus according to claim 2 wherein said machine includes mounting brackets and said first and second mounting shafts engage said mounting brackets for rigidly securing said front and rear support structures to said printing machine.

4. An apparatus for controlling belt motion in an electro-photographic printing machine comprising:

a continuous photoreceptor belt for receiving an image;

a drive roller for driving said belt about a continuous path;

a motor coupled to said drive roller providing power to said drive roller for driving said belt;

a tension roller engaging said belt to maintain tension thereon;

a strip roller for engaging said belt at a position displaced from said tension roller and said drive roller, such that said drive roller and said strip roller each have a higher axial roll stiffness than said tension roller;

a support structure for holding said drive, tension, and strip rollers;

said belt being entrained about said drive, tension, and strip rollers;

a guidance control means for providing tension on the tension roller and guiding said belt in close proximity to said tension roller, said guidance control means being biased toward said belt to maintain said tension.

5. The apparatus according to claim 4 wherein said guidance control means includes means for rotatably holding said tension roller, a spring member for biasing said holding means towards said belt, said spring means engaging a rigid structure.

6. The apparatus according to claim 5 wherein said structure includes a slot, said guidance control means includes a slot engaging member for permitting movement along a path defined along said slot, and said spring member engages a portion of said structure.

7. An apparatus for controlling a belt motion in an electro-photographic printing machine comprising:

a continuous photoreceptor belt for receiving an image;

a drive roller for driving said belt about a continuous path;

a motor coupled to said drive roller providing power to said drive roller for driving said belt;

a tension roller engaging said belt to maintain tension thereon;

a strip roller for engaging said belt at a position displaced from said tension roller and said drive roller;

said belt being entrained about said drive, tension, and strip rollers;

a front support structure and a rear support structure arranged in spaced relationship for supporting said drive, tension, and strip rollers; and means for controlling external mounting position of said front support structure and said rear support structure including:

first and second shafts, each having respectively a first and second head and a first and second bevelled end; and further comprising:

machine mounting brackets for engaging the first and second bevelled ends of said first and second shafts;

a module drawer;

module drawer brackets for engaging said first and second heads of said first and second shafts;

means for biasing said bevelled ends toward said machine mounting brackets; and means for securing said first and second heads of said first and second shafts in engagement with said module drawer brackets.

8. The apparatus according to claim 7 wherein said means for biasing said first and second bevelled ends of said first and second shafts includes a cantilevered spring.

9. An apparatus for controlling a belt motion in an electro-photographic printing machine comprising:

a continuous photoreceptor belt for receiving an image;

a drive roller for driving said belt about a continuous path;

a motor coupled to said drive roller providing power to said drive roller for driving said belt;

a tension roller engaging said belt to maintain tension thereon;

a strip roller for engaging said belt at a position displaced from said tension roller and said drive roller;

said belt being entrained about said drive, tension, and strip rollers;

a front support structure and a rear support structure arranged in spaced relationship for supporting said drive, tension, and strip rollers;

said drive roller, said strip roller and said tension roller having sufficient stiffness to reduce lateral belt motion to less than 80 microns.

10. The apparatus according to claim 9 wherein the stiffness of the driver roller ranges between 0.03 mm to 0.125 mm of belt displacement when subjected to a lateral force ranging respectively between 900 and 300 grams at a belt wrap angle of 90° and 16 pounds of tension.

11. The apparatus according to claim 9 wherein said strip roller has a belt displacement of between 0.125 and 0.04 mm at a lateral force respectively of between 900 and 300 grams at a belt wrap angle of 90° and 16 pounds tension.

12. The apparatus according to claim 9 wherein said tension roller has a belt displacement of between 0.11 and 0.02 mm at a lateral force respectively of between 900 and 300 grams at a belt wrap angle of 180° and 16 pounds of tension.

13. An apparatus for controlling a belt motion in an electro-photographic printing machine comprising:

a continuous photoreceptor belt for receiving an image;

a drive roller for driving said belt about a continuous path;

a motor coupled to said drive roller providing power to said drive roller for driving said belt;

a tension roller engaging said belt to maintain tension thereon;

a strip roller for engaging said belt at a position displaced from said tension roller and said drive roller;

said belt being entrained about said drive, tension, and strip rollers;

a front support structure and a rear support structure arranged in spaced relationship for supporting said drive, tension, and strip rollers; and a first single piece mounting shaft and a second single piece mounting shaft, each extending through said front support structure and said rear support structure for mounting said belt and said drive, tension, and strip rollers to a portion of said printing machine;

a guidance control means for providing tension on the tension roller and guiding said belt in close proximity to said tension roller, said guidance control means being biased towards said belt to maintain said tension;

first and second shafts, each having respectively a first and second head and a first and second beveled end;

and further comprising machine mounting brackets for engaging the first and second beveled ends of said first and second shafts, a module drawer, module drawer brackets for engaging said first and second heads of said first and second shafts, means for biasing said first and second beveled ends of said first and second shafts towards said machine mounting brackets, and means for securing said first and second heads of said first and second shafts in engagement with said module drawer brackets;

said drive roller, said strip roller and said tension roller being sufficiently stiff and cooperating with said first and second single piece mounting shafts, said guidance control means, and said mounting brackets for limiting said lateral motion of said belt to less than 80 microns during movement of said belt about said drive, tension, and strip rollers.

* * * * *

UNITED STATES PATENT AND TRADEMARK OFFICE

CERTIFICATE OF CORRECTION

PATENT NO. : 5,233,388

DATED : August 3, 1993

INVENTOR(S) : Scott A. Reese, et al

It is certified that error appears in the above-indentified patent and that said Letters Patent is hereby corrected as shown below:

IN THE ABSTRACT: Line 9, change "aid" to --aids--.

| Column | Line | |
|---|---|---|
| 1 | 32 | Delete "which". |
| 2 | 23 | After "copier" delete ",". |
| 2 | 35 | After "microns" insert --,--. |
| 2 | 50 | After "on" insert --a--. |
| 3 | 1 | Change "do" to --perform--. |
| 6 | 50 | Change "under color" to --under-color--. |
| 6 | 52 | Change "documents" to --documents'--. |
| 6 | 63 | Change "role" to --roll--. |

UNITED STATES PATENT AND TRADEMARK OFFICE

CERTIFICATE OF CORRECTION

PATENT NO. : 5,233,388

DATED : August 3, 1993

INVENTOR(S) : Scott A. Reese, et al

It is certified that error appears in the above-indentified patent and that said Letters Patent is hereby corrected as shown below:

| Column | Line | |
|---|---|---|
| 8 | 17 | After "two" insert --,--; after "piece" insert --,--. |
| 8 | 40 | Change "142" to --140--. |
| 9 | 45 | Change "roller" to --rollers--. |

Signed and Sealed this

Third Day of May, 1994

Bruce Lehman

*Attest:*

BRUCE LEHMAN

*Attesting Officer*

*Commissioner of Patents and Trademarks*